US009834834B2

(12) United States Patent
Yamauchi et al.

(10) Patent No.: US 9,834,834 B2
(45) Date of Patent: Dec. 5, 2017

(54) APPARATUS FOR SUPPLYING ZN—AL ALLOY TO MOLTEN ZINC POT

(71) Applicant: Nippon Steel & Sumitomo Metal Corporation, Tokyo (JP)

(72) Inventors: Yu Yamauchi, Tokyo (JP); Mikio Kawamura, Tokyo (JP); Masaaki Omodaka, Tokyo (JP); Hideki Nishimura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/254,972

(22) Filed: Sep. 1, 2016

(65) Prior Publication Data

US 2016/0369384 A1 Dec. 22, 2016

Related U.S. Application Data

(62) Division of application No. 14/124,306, filed as application No. PCT/JP2013/055821 on Mar. 4, 2013, now Pat. No. 9,458,530.

(30) Foreign Application Priority Data

Mar. 5, 2012 (JP) ..... 2012-047546

(51) Int. Cl.
*C23C 2/06* (2006.01)
*C23C 2/40* (2006.01)
(Continued)

(52) U.S. Cl.
CPC ..... *C23C 2/06* (2013.01); *B05C 3/04* (2013.01); *C23C 2/003* (2013.01); *C23C 2/40* (2013.01)

(58) Field of Classification Search
None
See application file for complete search history.

(56) References Cited

U.S. PATENT DOCUMENTS 4,330,574 A * 5/1982 Pierson ..... C23C 2/40 427/319
4,557,925 A * 12/1985 Lindahl ..... A61K 9/2813 424/482

FOREIGN PATENT DOCUMENTS

CN 201217681 4/2009
CN 101709408 A 5/2010
(Continued)

OTHER PUBLICATIONS

International Search Report dated May 21, 2013 issued in corresponding PCT Application No. PCT/JP2013/055821 [With English Translation].

(Continued)

*Primary Examiner* — Dah-Wei D Yuan
*Assistant Examiner* — Jethro M Pence
(74) *Attorney, Agent, or Firm* — Birch, Stewart, Kolasch & Birch, LLP

(57) ABSTRACT

A method of supplying a Zn—Al alloy to a molten zinc pot which accommodates a molten zinc bath in a hot dip galvanizing line, includes: supplying the Zn—Al alloy from a supply portion provided at a lower portion of an insertion guide having a pipe shape, in which the supply portion is immersed between an inner wall of the molten zinc pot on a downstream side in a travelling direction of a steel sheet and a front support roll installed in the molten zinc bath at a depth within ±400 mm from a lower end of the front support roll, and an inside of the insertion guide is pressurized by inert gas to prevent the molten zinc bath from advancing to the inside of the insertion guide.

12 Claims, 11 Drawing Sheets

(51) Int. Cl.

| | |
|---|---|
| ***B05C 3/02*** | (2006.01) |
| ***B05C 3/04*** | (2006.01) |
| ***C23C 2/00*** | (2006.01) |

(56) References Cited

FOREIGN PATENT DOCUMENTS

| | | | | | |
|---|---|---|---|---|---|
| CN | 101717906 | A | | 6/2010 | |
| CN | 102216485 | A | | 10/2011 | |
| JP | 49-76732 | | | 7/1974 | |
| JP | 51-59423 | | | 5/1976 | |
| JP | 2-179858 | A | | 7/1990 | |
| JP | 3-53548 | U | | 5/1991 | |
| JP | 2001-164349 | A | | 6/2001 | |
| JP | 2003-231958 | A | | 8/2003 | |
| JP | 2005-240155 | A | | 9/2005 | |
| KR | 2003-0053815 | | * | 7/2003 | ..... C23C 2/06 |
| KR | 2003-0053815 | A | | 7/2003 | |
| KR | 2003-0092359 | A | | 12/2003 | |

OTHER PUBLICATIONS

Notice of Allowance dated Jul. 22, 2015 issued in corresponding Korean Application No. 10-2013-7032806. [with English translation].

Notice of Allowance dated Oct. 29, 2013 from corresponding Japanese Application No. 2013-531594 [With English Translation].

Notice of Allowance dated Jun. 2, 2016, issued in U.S. Appl. No. 14/124,306.

Office Action dated Jan. 21, 2015 issued in corresponding Chinese Application No. 201380001688.9.

Office Action dated Jan. 22, 2015 issued in corresponding Korean Application No. 10-2013-7032806.

Office Action dated Oct. 15, 2015, issued in U.S. Appl. No. 14/124,306.

Office Aftion dated Jan. 6, 2016, issued in U.S. Appl. No. 14/124,306.

* cited by examiner

APPARATUS FOR SUPPLYING ZN—AL ALLOY TO MOLTEN ZINC POT

This application is a divisional of and claims priority to application Ser. No. 14/124,306, filed Dec. 6, 2013, which is the U.S. national phase of International Application PCT/JP2013/055821, filed Mar. 4, 2013. Priority is also claimed to Japanese application 2012-047546, filed Mar. 5, 2012. All of those applications are hereby expressly incorporated by reference in the present application.

TECHNICAL FIELD

The present invention relates to a method of supplying a Zn—Al alloy to a molten zinc pot in a continuous hot dip galvanizing line for a steel sheet, a method of adjusting the concentration of Al in a molten zinc bath, and an apparatus for supplying a Zn—Al alloy to a molten zinc pot.

BACKGROUND ART

The concentration of Al in a molten zinc bath (the weight % of Al to the entire molten zinc bath) in a molten zinc pot disposed in a continuous hot dip galvanizing line for a steel sheet affects the quality of a galvanized steel sheet, particularly, the quality of an alloy layer of base iron and zinc. Therefore, in order to stabilize the quality of the galvanized steel sheet, it is important to maintain the concentration of Al in the molten zinc bath at a constant level.

Hitherto, for the purpose of compensating the amount of molten zinc taken out of the molten zinc pot by a steel sheet, a zinc ingot containing Al is injected to the molten zinc pot from the above the molten zinc pot to maintain the amount of molten zinc in the molten zinc bath at a constant level and to roughly adjust the concentration of Al in the molten zinc (Patent Document 1).

In addition, a method is employed in which the concentration of Al in the molten zinc bath is measured by ICP analysis performed by drawing up a portion of the molten zinc in the molten zinc pot or an Al concentration meter installed in the molten zinc pot. Then, when the concentration of Al in the molten zinc bath is reduced, a Zn—Al alloy piece (so-called aluminum cake) having a higher concentration of contained Al than that of a zinc ingot containing Al is injected, controlled by an operator, into the surface layer of the molten zinc bath from the above the molten zinc pot, thereby finely adjusting the concentration of Al in the molten zinc. In general, the weight of the zinc ingot is tens to hundreds of kilograms, and the weight of the Zn—Al alloy piece (aluminum cake) for fine adjustment is about 5 to 10 kg.

Al in the zinc ingot containing Al and the Zn—Al alloy piece has a smaller specific gravity than zinc. Therefore, in a case where the zinc ingot containing Al or the Zn—Al alloy piece is injected in the above-described method, the concentration of Al at the bath surface of the molten zinc bath is increased, and thus, the surrounding of the bath surface is in a state of having a high Al concentration. On the other hand, the bottom portion of the molten zinc pot is in a state of having a low Al concentration, and thus bottom dross is likely to be generated and deposited on the bottom portion. The bottom dross rises due to stirring flow in the pot and adheres to the steel sheet when the sheet-threading speed of the continuous hot dip galvanizing line is in high speed. The bottom dross that adheres to the steel sheet is a cause for pressing flaws and degrades the product value of the galvanized steel sheet. Therefore, in the present, in order to avoid this problem, the upper limit of the sheet-threading speed is restricted, and the bottom dross is pumped out by regularly stopping facilities. The restriction on the sheet-threading speed and the regular stop of the facilities are the causes for degradation in productivity.

In addition, during the injection by the control of the operator as described above, the injection pitch is roughened, and an increase in the difference between a target Al concentration and an actually acquired Al concentration cannot be avoided. Accordingly, the quality of the alloy layer of the galvanized steel sheet is not stabilized, and insufficient alloying called half-baking or excessive alloying occurs, which is the cause for the degradation in product quality.

PRIOR ART DOCUMENT

Patent Document

[Patent Document 1] Japanese Unexamined Patent Application, First Publication No. 2005-240155

DISCLOSURE OF THE INVENTION

Problem that the Invention is to Solve

An object of the present invention is to solve the above-described problems. That is, an object of the present invention is to provide a method of supplying a Zn—Al alloy to a molten zinc pot in which the concentration of Al in a molten zinc bath in the molten zinc pot in a continuous hot dip galvanizing line for a steel sheet is always maintained at a constant level and pressing flaws, insufficient alloying, excessive alloying, and the like do not occur even when the sheet is passed at a higher speed than that according to the related art, a method of adjusting the concentration of Al in a molten zinc bath, and an apparatus for supplying a Zn—Al alloy to a molten zinc pot.

Means for Solving the Problems

The present invention is contrived on the basis of the above knowledge, and the gist thereof is as follows.

(1) That is, according to an aspect of the present invention, a method of supplying a Zn—Al alloy to a molten zinc pot which accommodates a molten zinc bath in a hot dip galvanizing line, includes: supplying the Zn—Al alloy from a supply portion provided at a lower portion of an insertion guide having a pipe shape, in which the supply portion is immersed between an inner wall of the molten zinc pot on a downstream side in a travelling direction of a steel sheet and a front support roll installed in the molten zinc bath at a depth within ±400 mm from a lower end of the front support roll, and an inside of the insertion guide is pressurized by inert gas to prevent the molten zinc bath from advancing to the inside of the insertion guide.

(2) In the method of supplying a Zn—Al alloy to a molten zinc pot according to (1), the Zn—Al alloy may have a form of any one of a wire, a chip, and powder.

(3) In the method of supplying a Zn—Al alloy to a molten zinc pot according to (1), the supply portion of the insertion guide may be installed in a discharge flow which is generated between the front support roll in the molten zinc bath and the steel sheet which travels.

(4) According to another aspect of the present invention, a method of adjusting a concentration of Al in a molten zinc bath includes: controlling an amount of the Zn—Al alloy supplied according to the method of supplying a Zn—Al alloy to a molten zinc pot according to any one of (1) to (3) depending on the concentration of Al measured by an Al concentration meter installed in the molten zinc pot.

(5) According to another aspect of the present invention, an apparatus for supplying a Zn—Al alloy to a molten zinc pot which accommodates a molten zinc bath in which a front support roll is immersed in a hot dip galvanizing line, includes: an insertion guide having a pipe shape, which has a supply portion at a lower portion and is installed between an inner wall of the molten zinc pot on a downstream side in a travelling direction of a steel sheet and the front support roll installed in the molten zinc bath; and a gas supply device which supplies inert gas into the insertion guide, in which an installation position of the supply portion is in the molten zinc bath and at a depth within ±400 mm from a lower end of the front support roll, and the Zn—Al alloy is supplied to the molten zinc bath from the supply portion of the insertion guide.

Effect of the Invention

According to the aspects of the present invention, by supplying the Zn—Al alloy into the molten zinc pot from the supply portion provided at the lower portion of the insertion guide having a pipe shape, which is installed between the inner wall of the molten zinc pot on the downstream side in the travelling direction of the steel sheet and the front support roll installed in the molten zinc bath at a depth within ±400 mm from the lower end of the front support roll in the molten zinc bath, Al can be uniformly diffused in the molten zinc bath. As a result, the generation of bottom dross due to the non-uniformity of the concentration of Al in the molten zinc bath in the molten zinc pot is suppressed, and thus pressing flaws caused by rising of the bottom dross are reduced even when the sheet-threading speed is increased. Therefore, it is possible to achieve the enhancement in productivity.

In addition, according to the aspects of the present invention, by controlling the amount of the Zn—Al alloy supplied depending on the concentration of Al in the molten zinc bath measured by the Al concentration meter, the concentration of Al in the molten zinc bath including the surface of the steel sheet on which an alloying reaction between base iron and zinc occurs can be always maintained at a constant level. Therefore, the quality of the alloy layer is stabilized, and thus the occurrence of insufficient alloying called half-baking or excessive alloying can be prevented.

EMBODIMENT OF THE INVENTION

Hereinafter, exemplary embodiments of the present invention will be described.

Figure 1:
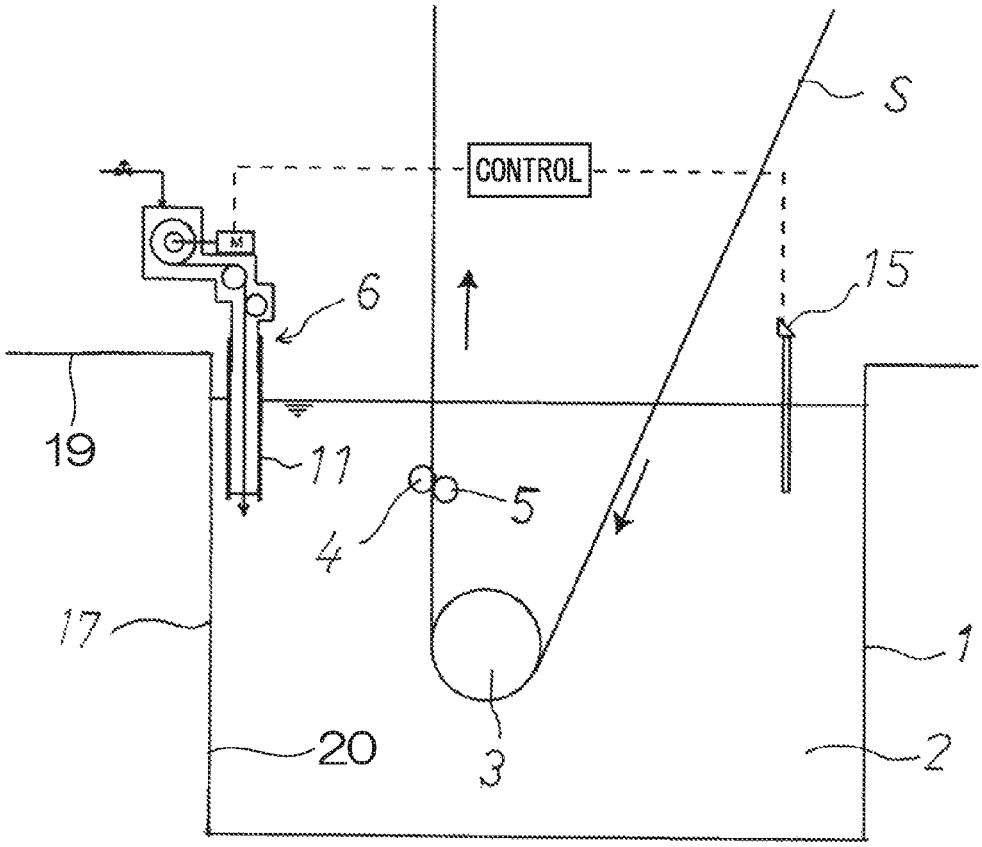
FIG. 1 is an explanatory view of a method of supplying a Zn—Al alloy to a molten zinc pot according to an embodiment of the present invention.

In FIG. 1, reference numeral 1 denotes a molten zinc pot in a hot dip galvanizing line for a steel sheet, and reference numeral 2 denotes a molten zinc bath accommodated therein. In the molten zinc pot 1, a sink roll 3, a front support roll 4, and a back support roll 5 are installed in a state of being immersed in the molten zinc bath 2. A steel sheet S is introduced into the molten zinc bath 2 in an inclined direction as illustrated in FIG. 1, is turned by the sink roll 3, and is then pulled up in the vertical direction between the front support roll 4 and the back support roll 5 in the molten zinc bath. In this embodiment, the rightward direction in FIG. 1 is referred to as an upstream side in the travelling direction of the steel sheet, and the leftward direction in FIG. 1 is referred to as a downstream side in the travelling direction of the steel sheet.

Figure 2:
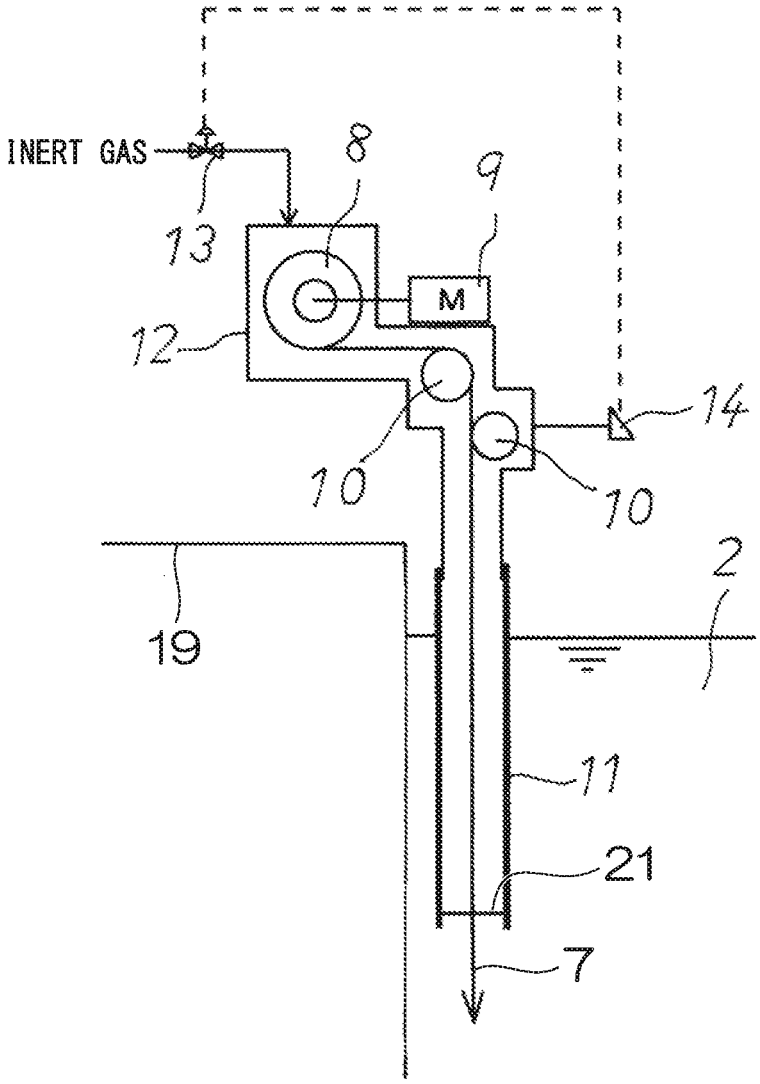
FIG. 2 is a cross-sectional view of the main part of FIG. 1.

Above the liquid surface of the molten zinc pot 1, an adding apparatus 6 for a Zn—Al alloy (an apparatus for supplying a Zn—Al alloy) is provided. The details thereof are as illustrated in FIG. 2. A wire 7 of the Zn—Al alloy is wound around a drum 8, and the wire 7 of the Zn—Al alloy is drawn out in the downward direction via guide rolls 10 and 10 by rotating the drum 8 using a motor 9 to be supplied into the molten zinc bath 2 from a supply portion provided at the lower portion of an insertion guide 11 having a pipe shape. Considering the safety of an operation of replacing the Zn—Al alloy wire, it is preferable that the drum 8 be not disposed above the bath surface of the molten zinc but be disposed above an operation floor 19. The Zn—Al alloy wire 7 is preferably continuously supplied but may also be intermittently supplied at a short interval. The insertion guide 11 is made of a ceramic having heat resistance, such as alumina, and is installed between an inner wall 20 on the downstream side in the travelling direction of the steel sheet in the molten zinc pot and the front support roll installed in the molten zinc bath, that is, in a hot dip galvanizing bath on the left of the figure from the front support roll. Moreover, the above-mentioned supply portion is set to have a depth within ±400 mm from the lower end of the front support roll 4 in the molten zinc bath.

The entirety of the adding apparatus 6 is accommodated in a hermetic seal box 12 as illustrated in FIG. 2, and to the inside thereof, inert gas such as nitrogen gas or Ar gas is supplied from a gas supply device (not illustrated) through a valve 13. Reference numeral 14 denotes a pressure meter that detects the internal pressure of the hermetic seal box 12. The pressure meter controls the internal pressure of the insertion guide 11 by controlling the amount of inert gas supplied from the gas supply device through the valve 13. The supplied inert gas presses the molten zinc that attempts to advance into the insertion guide 11 down to, for example, the surrounding of the lower end of the insertion guide 11. Accordingly, the wire 7 of the Zn—Al alloy is lowered to the lower end of the insertion guide 11 without coming into contact with the molten zinc and at the moment of coming out of the lower end portion, comes into contact with the molten zinc and starts dissolving, that is, the supply of the Zn—Al alloy into the molten zinc bath is started. The position at which the supply of the Zn—Al alloy to the molten zinc bath is started corresponds to the supply portion of the insertion guide. In addition, when air (atmosphere) is used instead of the inert gas, there is a concern that the molten zinc and the Zn—Al alloy may be oxidized, which is not preferable.

As illustrated in FIG. 1, an appropriate number of Al concentration meters 15 are installed in the molten zinc pot 1. In this embodiment, the amount of the Zn—Al alloy supplied is controlled depending on the Al concentration measured by the Al concentration meters 15. Accordingly, the concentration of Al in the molten zinc bath 2 can be maintained at a constant level. In addition, the amount of the Zn—Al alloy supplied can be controlled by, for example, changing the transport speed of the wire 7. When the transport speed of the wire is increased, there may be cases where the wire is not immediately dissolved even when coming into contact with the molten zinc. However, in this case, the wire may be pre-heated.

Next, the reason that the supply portion of the insertion guide 11 is set to have a depth within ±400 mm from the lower end of the front support roll 4 in the molten zinc bath 2 will be described.

Figure 3:
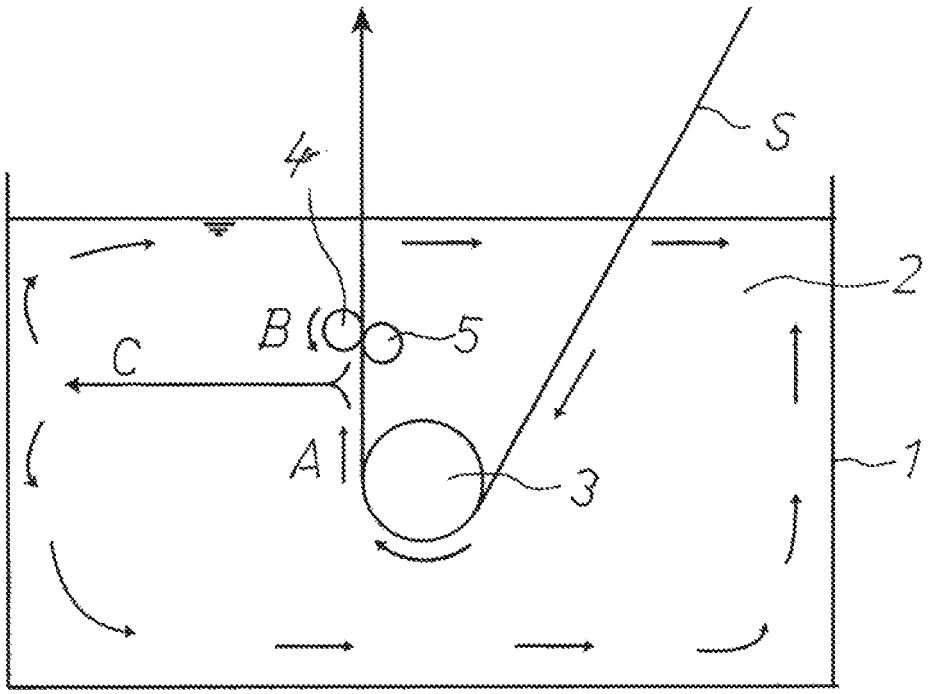
FIG. 3 is a side view illustrating the flows of a molten zinc bath in the molten zinc pot.

FIG. 3 is a diagram illustrating the flows of the molten zinc bath generated in the molten zinc pot 1. In the molten zinc bath 2, a roll rotation flow B caused by the front support roll 4 and an accompanying flow A in the vicinity of the steel sheet S collide with each other and thus a strong discharge flow C which is directed toward the downstream side (to the left in the figure) in the traveling direction of the steel sheet is generated. The discharge flow C collides with the wall surface and is separated into upper and lower flows to be circulated in the entire molten zinc pot 1. In this embodiment, the position at which the Zn—Al alloy is supplied from the insertion guide 11 is set to be in the discharge flow C such that the Zn—Al alloy is efficiently and uniformly diffused on the strong discharge flow C.

Figure 4A:
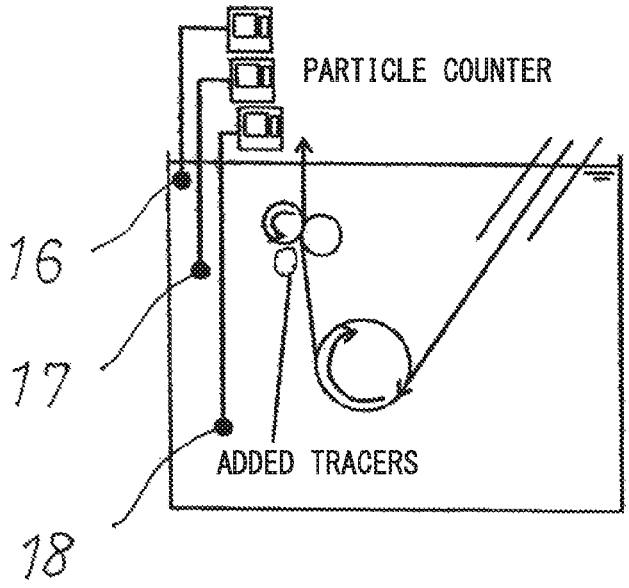
FIG. 4A is an explanatory view showing the respective positions of particle counters in a test using a water model, and is a side view.
Figure 4B:
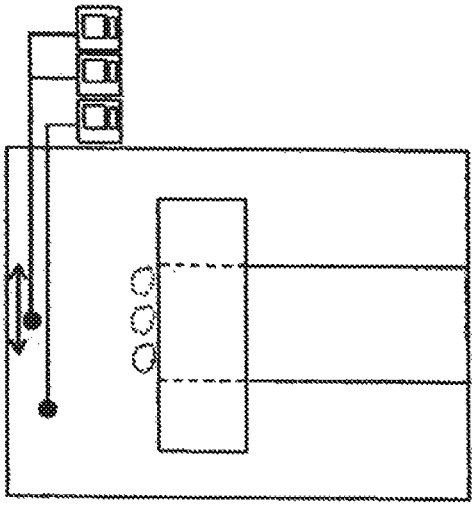
FIG. 4B is an explanatory view showing the respective positions of the particle counters in the test using the water model, and is a plan view.

As described above, the discharge flow C is directed toward the downstream side in the travelling direction of the steel sheet of the front support roll. Therefore, the inventors thought that it is effect to install the insertion guide so that the supply portion of the insertion guide is on the downstream side in the travelling direction of the steel sheet with respect to the front support roll. Moreover, for more detailed examination on the installation position of the insertion guide, the inventors conducted a test using a ⅕ scale water model which simulated the real equipment and the Froude number a plurality of numbers of times for flow analysis. In the flow analysis, acrylic tracers having a particle diameter of 50 μm were used, and the acrylic tracers were added from various depths to count the number of tracers detected by particle counters 16, 17, and 18 on the bath surface side and the bath bottom side. The positions of the particle counters 16, 17, and 18 are illustrated in FIGS. 4A and 4B. In addition, (the number of tracers detected on the bath surface side/the number of tracers detected on the bath bottom side) is referred to as a tracer detection ratio $\epsilon$, and the relationship between the distance from the lower end of the front support roll 4 to the position at which the acrylic tracers are added and the tracer detection ratio $\epsilon$ is arranged in the graph of FIG. 5. In addition, the distance from the front support roll of FIG. 5 is a value converted into the distance in the real facility from the ratio between the water model and the real facility.

Here, the number of tracers detected on the bath surface side used to obtain $\epsilon$ is the result measured by the particle counter 16 of FIG. 4A, and the number of tracers detected on the bath bottom side is the result measured by the particle counter 18 of FIG. 4A.

In addition, FIG. 4A is a side view of a water tank used for the water model test. FIG. 4B is a plan view of the water tank. As can be seen from FIGS. 4A and 4B, the particle counters 16, 17, and 18 are installed at different positions in the depth direction and the width direction of the steel sheet.

Figure 5:
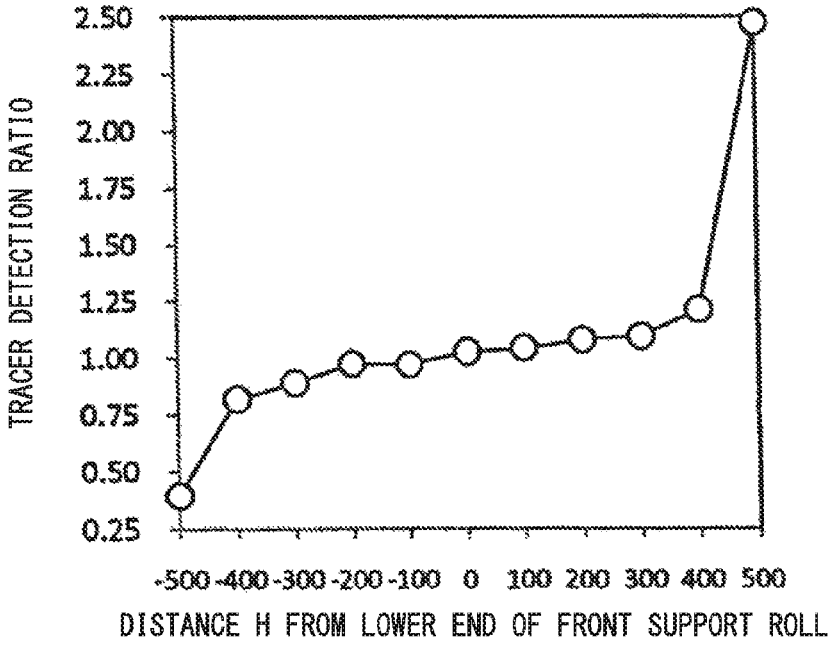
FIG. 5 is a graph showing the relationship between a distance from the lower end of a front support roll to a position at which acrylic tracers are added and a tracer detection ratio $\epsilon$, which are converted into values of the real facility, in the test using the water model.

As shown in the graph of FIG. 5, it was confirmed that when the position at which the acrylic tracers are added was in a range of about ±400 mm from the lower end of the front support roll 4 (within 400 mm on the bath surface side and within 400 mm on the bath bottom side), the tracer detection ratio $\epsilon$ had approached 1, that is, the acrylic tracers were uniformly dispersed on the bath surface side and the bath bottom side. Therefore, in the present invention, the Zn—Al alloy was supplied from the supply portion of the insertion guide 11 immersed at a depth within ±400 mm from the lower end of the front support roll 4. For more uniform distribution, a depth within ±300 mm from the lower end of the front support roll 4 is preferable, and a depth within ±200 mm therefrom is more preferable.

Figure 6:
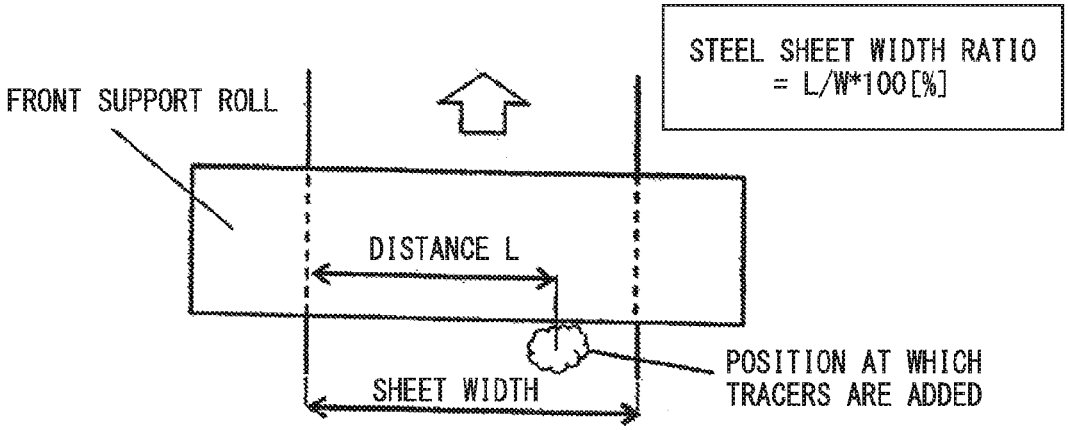
FIG. 6 is an explanatory view of a steel sheet width ratio.

Similarly, as illustrated in FIG. 6, the position at which the acrylic tracers were added was changed in the width direction of the steel sheet S and the numbers of tracers detected by the particle counters on the bath surface side and the bath bottom side at the same position in the width direction were counted. In addition, (the number of tracers detected on the bath surface side+the number of tracers detected on the bath bottom side)/the number of tracers injected was defined as a tracer detection ratio $\eta$ and was arranged in the graph of FIG. 7. Here, the number of tracers detected on the bath surface side used to obtain $\eta$ is the result measured by the particle counter 16 of FIG. 4A, and the number of tracers detected on the bath bottom side is the result measured by the particle counter 18 of FIG. 4A.

Figure 7:
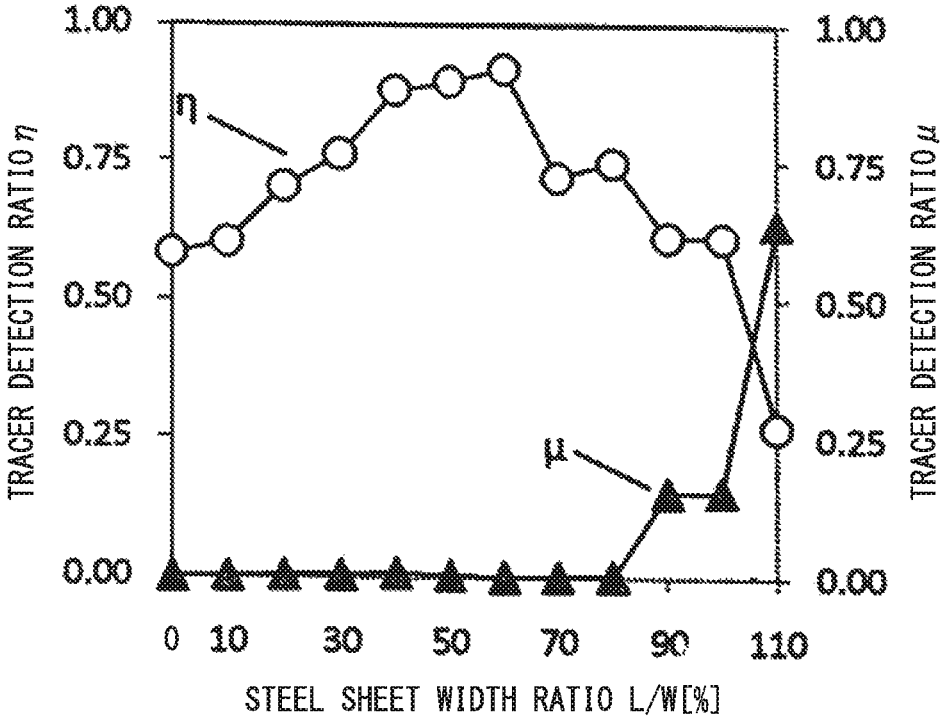
FIG. 7 is a graph showing the relationship between the steel sheet width ratio, a tracer detection ratio $\eta$, and a tracer detection ratio $\mu$.

The steel sheet width ratio of the horizontal axis of the graph represents a value (L/W) obtained by dividing a distance L from the edge of the steel sheet to the position at which the acrylic tracers are added by the sheet width W of the steel sheet as illustrated in FIG. 6. FIG. 7 also shows the tracer detection ratio $\mu$ obtained by dividing the number of tracers detected by the particle counter installed on the outside (steel sheet width ratio=110%) of the sheet width of the steel sheet by the number of tracers injected. In addition, the particle counter used to obtain $\mu$ is the particle counter 17 of FIG. 4A.

As can be seen from FIG. 7, it was confirmed that in a case where the acrylic tracers were added from the outer side than the edge of the steel sheet S, the number of tracers detected in the steel sheet width was reduced and the number of tracers detected in the surrounding of the edge of the steel sheet S was increased. This proves that the added Al is concentrated on the surrounding of the edge of the steel sheet S and causes alloying failure in the surrounding of the edge of the steel sheet S. In contrast, in a case where the acrylic tracers were added from the surrounding of the center of the steel sheet width, the tracer detection ratio η is high and Al is relatively efficiently dispersed. Therefore, the steel sheet width ratio (L/W) is preferably 0 to 100%, more preferably 20 to 80%, and most preferably 40 to 60%.

Examples

The content of the present invention described above was checked by the real equipment. The molten zinc pot had dimensions of 3.1 m×3.9 m×2.6 m (depth), and the Zn—Al alloy was supplied from the supply portion of the insertion guide by setting the supply portion of the insertion guide at the same height (depth) as the lower end of the front support roll.

Figure 8A:
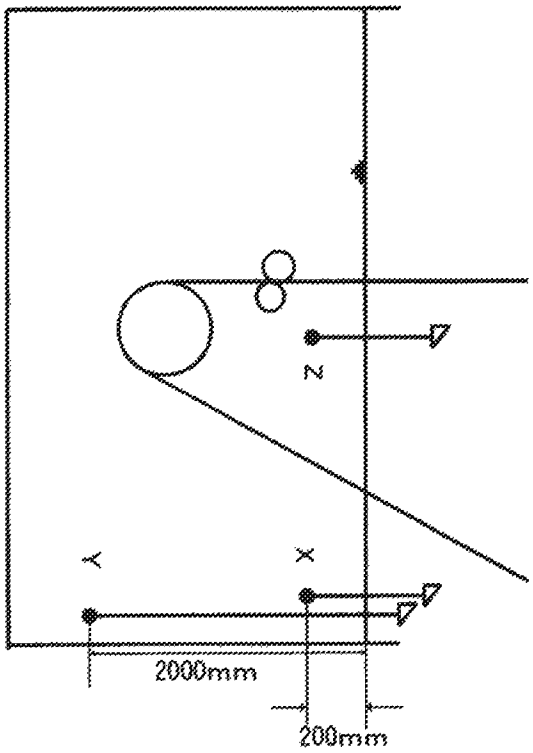
FIG. 8A is a side view illustrating the positions of Al concentration meters in Example.
Figure 8B:
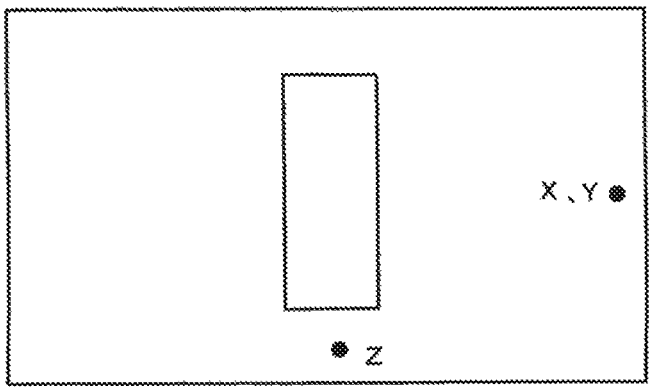
FIG. 8B is a side view illustrating the positions of the Al concentration meters in Example.

In order to measure the concentration of Al, the Al concentration meters were installed at positions X, Y, and Z in the molten zinc bath shown in FIG. 8. X is a position below 200 mm from the liquid surface (bath surface) in the vicinity of the inner wall surface on the upstream side in the travelling direction of the steel sheet, and Y is a position below 2000 mm from the liquid surface similarly in the vicinity of the inner wall surface on the upstream side in the travelling direction of the steel sheet. Z has the same depth as X on the outside in the width direction of the front support roll.

Figure 9:
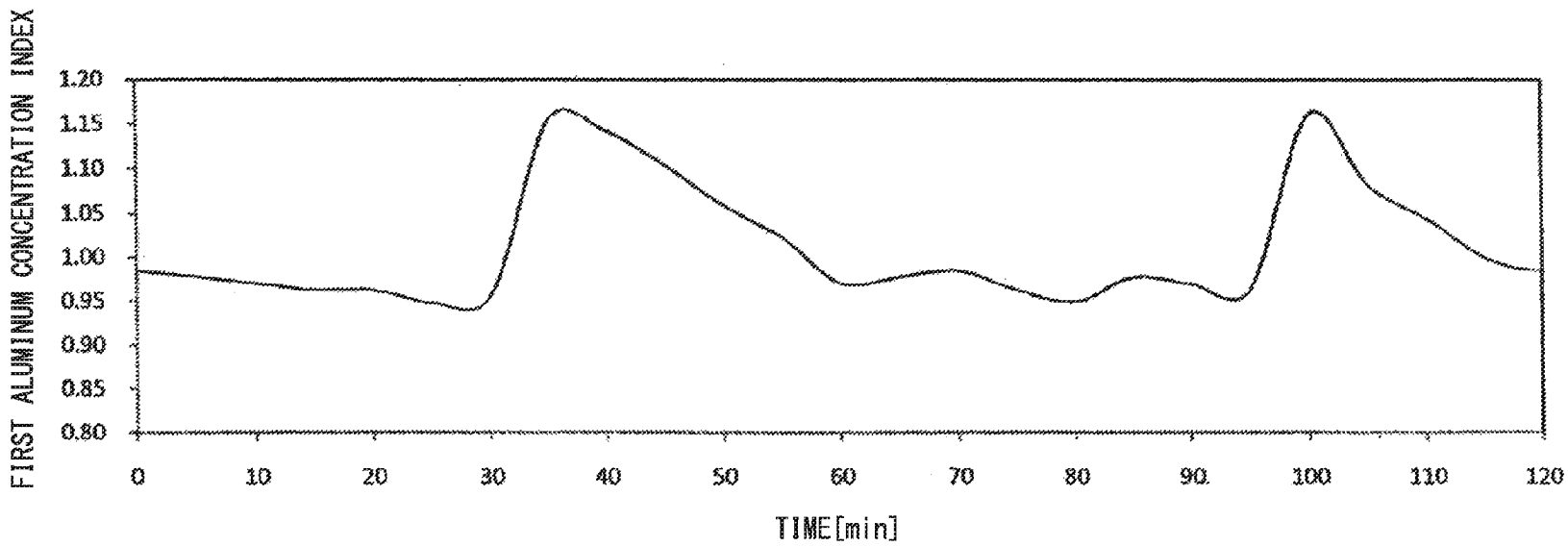
FIG. 9 is a graph showing the concentration of Al at a position X of FIGS. 8A and 8B.

FIG. 9 shows a change in the concentration of Al at the position X. The vertical axis represents a first Al concentration index shown as the concentration of Al in the related art/the concentration of Al in the method of the present invention. It was confirmed that contrary to the method of the present invention, in the related art (a method of injecting aluminum cakes), the concentration of Al was significantly changed due to the injection of the aluminum cakes.

Figure 10:
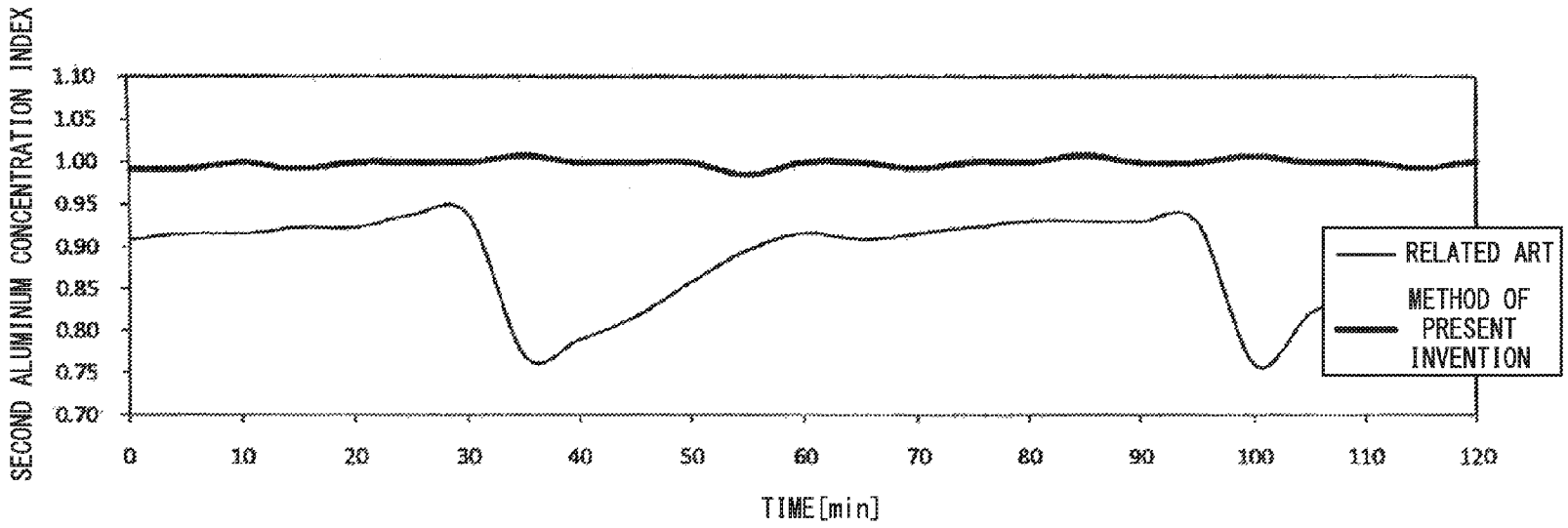
FIG. 10 is a graph showing the ratio of the concentration of Al at a position Y of FIGS. 8A and 8B to the concentration of Al at the position X of FIGS. 8A and 8B.

FIG. 10 shows a change in the ratio (a second Al concentration index) of the concentration of Al at the position X to the concentration of Al at the position Y in the related art and in the method of the present invention. It appears that in the related art, the value is always smaller than 1 and Al is insufficiently supplied to the bath bottom portion. On the other hand, according to the present invention, the value was mostly stabilized to 1, and it was confirmed that the difference in the concentration of Al between the bath surface and the bath bottom of the molten zinc bath could be solved.

Figure 11:
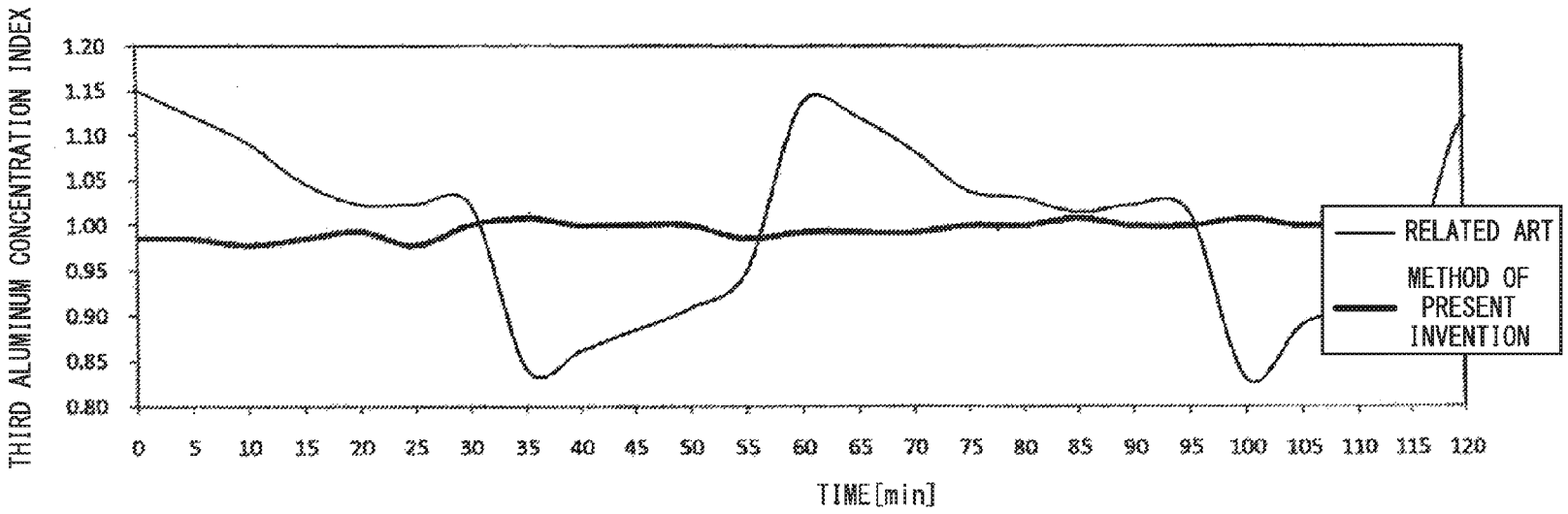
FIG. 11 is a graph showing the ratio of the concentration of Al at a position Z of FIGS. 8A and 8B to the concentration of Al at the position X of FIGS. 8A and 8B.

FIG. 11 shows a change in the ratio (a third Al concentration index) of the concentration of Al at the position X to the concentration of Al at the position Z. In the related art, the concentration of Al is significantly increased due to the injection of the aluminum cakes and the concentration of Al is significantly changed with time. That is, it appears that it takes much time to stabilize the concentration of Al. On the other hand, according to the method of the present invention, the value of the third Al concentration index is always stabilized and thus the concentration of Al can be stabilized in the entire molten zinc pot.

Figure 12:
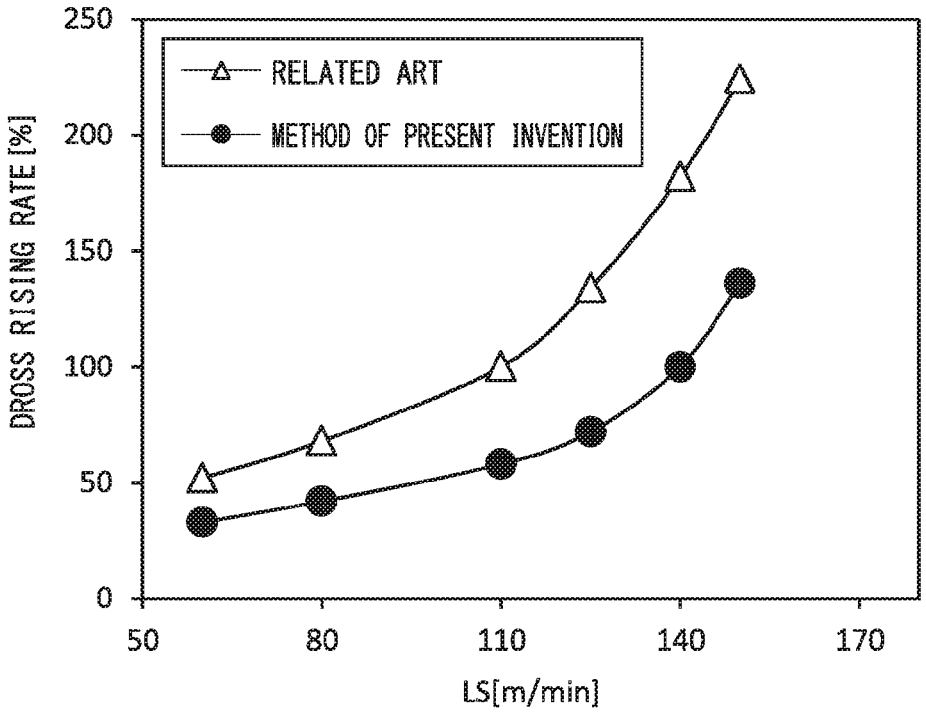
FIG. 12 is a graph showing a dross rising rate.

FIG. 12 shows how the sheet-threading speed of the steel sheet (line speed: LS) changes a dross rising rate. The dross rising rate is a value which indexes the number of pieces of dross suspended at 110 m/min, which is the sheet-threading speed of the related art, as 100 regarding the number of pieces of dross suspended. A reduction in the ratio of pieces of dross suspended indicates a reduction in the amount of dross deposited. According to the present invention, even when the sheet-threading speed was increased to 140 m/min, the dross rising rate could be suppressed to 100%, and a sheet-threading regulation speed could be increased by 30 m/min from that of the related art. Accordingly, productivity could be enhanced, and a reduction in an alloying failure rate during an actual operation to ½ of that of the related art had succeeded.

In addition, the present invention is not limited to the embodiments described above, and various design changes can be made without departing from the gist thereof. For example, in the above-described embodiment, the Zn—Al alloy is added in the form of a wire. However, the form of the Zn—Al alloy is not necessarily limited to the wire, and forms of chips, powder, and the like can be employed instead of the wire form. In the case of the chip or powder form, a quantitative delivery device such as a granular material may be used to supply it from the supply portion of the insertion guide having the pipe shape.

In addition, although the Zn—Al alloy is added in the above-described embodiment, other alloys such as a Zn—Al—Mg alloy can be applied as long as they are dissolved in the molten zinc bath.

In addition, although the Zn—Al alloy is supplied from the supply portion provided at the lower portion of the insertion guide in the above-described embodiment, the position of the supply portion is not limited to the lower portion of the insertion guide. For example, the dissolving start position of the Zn—Al alloy may be set to the surrounding of the center portion of the insertion guide by controlling the pressure of the inert gas, and a hole may be pierced in the side surface of the surrounding of the center portion of the insertion guide to supply the Zn—Al alloy from the hole into the molten zinc bath. In this case, the position (hole) at which the Zn—Al alloy is injected may be at a position within ±400 mm from the lower end of the front support roll.

In addition, although the insertion guide having a linear pipe shape is used in the above-described embodiment, the insertion guide may have a shape other than the linear shape, for example, a shape with a curvature as long as the supply position thereof can be set to a predetermined position.

As described above, according to the present invention, Al can be uniformly dispersed in the molten zinc bath. Therefore, even when the sheet is passed at a higher speed than that of the related art, pressing flaws due to the rising of the bottom dross are not generated, and insufficient alloying, excessive alloying, and the like due to the non-uniformity of the concentration of Al do not occur.

INDUSTRIAL APPLICABILITY

According to the present invention, Al can be uniformly diffused in the molten zinc bath. Therefore, the generation of bottom dross due to the non-uniformity of the concentration of Al in the molten zinc pot is suppressed, and thus pressing flaws caused by rising of the bottom dross are reduced even when the sheet-threading speed is increased. Therefore, it is possible to achieve the enhancement in productivity.

DESCRIPTION OF REFERENCE NUMERALS AND SIGNS

1: MOLTEN ZINC POT
2: MOLTEN ZINC BATH
3: SINK ROLL
4: FRONT SUPPORT ROLL
5: BACK SUPPORT ROLL
6: ADDING APPARATUS (APPARATUS FOR SUPPLYING Zn—Al ALLOY)

7: WIRE OF Zn—Al ALLOY
8: DRUM
9: MOTOR
10: GUIDE ROLLER
11: INSERTION GUIDE
12: HERMETIC SEAL BOX
13: VALVE
14: PRESSURE METER
15: Al CONCENTRATION METER
16, 17, 18: PARTICLE COUNTER
19: OPERATION FLOOR
20: INNER WALL
21: SUPPLY PORTION

What is claimed is:

1. An apparatus for supplying a Zn—Al alloy to a molten zinc pot which accommodates a molten zinc bath in which a front support roll is immersed in a hot dip galvanizing line, the apparatus comprising, an insertion guide having a pipe shape, which has an inert gas supply portion at a lower portion and is installed between an inner wall of the molten zinc pot on a downstream side in a travelling direction of a steel sheet and the front support roll installed in the molten zinc bath, wherein an installation position of the inert gas supply portion is in the molten zinc bath and at a depth within ±400 mm from a lower end of the front support roll, the Zn—Al alloy is supplied to the molten zinc bath from the inert gas supply portion of the insertion guide, the front support roll is situated between (a) the inner wall of the molten zinc pot on the downstream side in the travelling direction of a steel sheet being galvanized in the apparatus and (b) a boundary between a first area of the steel sheet in contact with the front support roll and a second area of the steel sheet which is out of contact with the front support roll and moves away from the front support roll.

2. The apparatus for supplying a Zn—Al alloy to a molten zinc pot according to claim 1, wherein the installation position of the inert gas supply portion is in the molten zinc bath and at a depth within ±300 mm from the lower end of the front support roll.

3. The apparatus for supplying a Zn—Al alloy to a molten zinc pot according to claim 1, wherein the installation position of the inert gas supply portion is in the molten zinc bath and at a depth within ±200 mm from the lower end of the front support roll.

4. The apparatus for supplying a Zn—Al alloy to a molten zinc pot according to claim 1, wherein the installation position of the inert gas supply portion is in the molten zinc bath and in a range from a first plane including an edge of the steel sheet and perpendicular to a width direction of the steel sheet to a second plane including a line on the steel sheet 100% of a width of the steel sheet away from the edge of the steel sheet and perpendicular to the width direction of the steel sheet.

5. The apparatus for supplying a Zn—Al alloy to a molten zinc pot according to claim 1, wherein the installation position of the inert gas supply portion is in the molten zinc bath, at a depth within ±300 mm from the lower end of the front support roll, and in a range from a first plane including an edge of the steel sheet and perpendicular to a width direction of the steel sheet to a second plane including a line on the steel sheet 100% of a width of the steel sheet away from the edge of the steel sheet and perpendicular to the width direction of the steel sheet.

6. The apparatus for supplying a Zn—Al alloy to a molten zinc pot according to claim 1, wherein the installation position of the inert gas supply portion is in the molten zinc bath, at a depth within ±200 mm from the lower end of the front support roll, and in a range from a first plane including an edge of the steel sheet and perpendicular to a width direction of the steel sheet to a second plane including a line on the steel sheet 100% of a width of the steel sheet away from the edge of the steel sheet and perpendicular to the width direction of the steel sheet.

7. The apparatus for supplying a Zn—Al alloy to a molten zinc pot according to claim 1, wherein the installation position of the inert gas supply portion is in the molten zinc bath and in a range from a first plane including a first line on the steel sheet a length of 20% of a width of the steel sheet away from an edge of the steel sheet and perpendicular to a width direction of the steel sheet to a second plane including a second line on the steel sheet the length of 80% of a width of the steel sheet away from the edge of the steel sheet and perpendicular to the width direction of the steel sheet.

8. The apparatus for supplying a Zn—Al alloy to a molten zinc pot according to claim 1, wherein the installation position of the inert gas supply portion is in the molten zinc bath, at a depth within ±300 mm from the lower end of the front support roll, and in a range from a first plane including a first line on the steel sheet a length of 20% of a width of the steel sheet away from an edge of the steel sheet and perpendicular to a width direction of the steel sheet to a second plane including a second line on the steel sheet the length of 80% of a width of the steel sheet away from the edge of the steel sheet and perpendicular to the width direction of the steel sheet.

9. The apparatus for supplying a Zn—Al alloy to a molten zinc pot according to claim 1, wherein the installation position of the inert gas supply portion is in the molten zinc bath, at a depth within ±200 mm from the lower end of the front support roll, and in a range from a first plane including a first line on the steel sheet a length of 20% of a width of the steel sheet away from an edge of the steel sheet and perpendicular to a width direction of the steel sheet to a second plane including a second line on the steel sheet the length of 80% of a width of the steel sheet away from the edge of the steel sheet and perpendicular to the width direction of the steel sheet.

10. The apparatus for supplying a Zn—Al alloy to a molten zinc pot according to claim 1, wherein the installation position of the inert gas supply portion is in the molten zinc bath and in a range from a first plane including a first line on the steel sheet a length of 40% of a width of the steel sheet away from an edge of the steel sheet and perpendicular to a width direction of the steel sheet to a second plane including a second line on the steel sheet the length of 60% of a width of the steel sheet away from the edge of the steel sheet and perpendicular to the width direction of the steel sheet.

11. The apparatus for supplying a Zn—Al alloy to a molten zinc pot according to claim 1, wherein the installation position of the inert gas supply portion is in the molten zinc bath, at a depth within ±300 mm from the lower end of the front support roll, and in a range from a first plane including a first line on the steel sheet a length of 40% of a width of the steel sheet away from an edge of the steel sheet and perpendicular to a width direction of the steel sheet to a second plane including a second line on the steel sheet the length of 60% of a width of the steel sheet away from the edge of the steel sheet and perpendicular to the width direction of the steel sheet.

12. The apparatus for supplying a Zn—Al alloy to a molten zinc pot according to claim 1, wherein the installation position of the inert gas supply portion is in the molten zinc bath, at a depth within ±200 mm from the lower end of the front support roll, and in a range from a first plane including a first line on the steel sheet a length of 40% of a width of the steel sheet away from an edge of the steel sheet and perpendicular to a width direction of the steel sheet to a second plane including a second line on the steel sheet the length of 60% of a width of the steel sheet away from the edge of the steel sheet and perpendicular to the width direction of the steel sheet.

* * * * *